US009920408B2

(12) United States Patent
Nam et al.

(10) Patent No.: US 9,920,408 B2
(45) Date of Patent: Mar. 20, 2018

(54) HOT STAMPING PRODUCT WITH ENHANCED TOUGHNESS AND METHOD FOR MANUFACTURING THE SAME

(71) Applicant: HYUNDAI STEEL COMPANY, Incheon (KR)

(72) Inventors: Seung-Man Nam, Dangjin-si (KR); Seung-Ha Lee, Daegu (KR)

(73) Assignee: HYUNDAI STEEL COMPANY, Incheon (KR)

( * ) Notice: Subject to any disclaimer, the term of this patent is extended or adjusted under 35 U.S.C. 154(b) by 247 days.

(21) Appl. No.: 14/762,466

(22) PCT Filed: May 15, 2013

(86) PCT No.: PCT/KR2013/004293

§ 371 (c)(1),
(2) Date: Jul. 22, 2015

(87) PCT Pub. No.: WO2014/181907

PCT Pub. Date: Nov. 13, 2014

(65) Prior Publication Data

US 2015/0361532 A1 Dec. 17, 2015

(30) Foreign Application Priority Data

May 9, 2013 (KR) ..... 10-2013-0052405

(51) Int. Cl.
*C22C 38/38* (2006.01)
*C21D 8/00* (2006.01)
(Continued)

(52) U.S. Cl.
CPC ..... *C22C 38/38* (2013.01); *C21D 1/673* (2013.01); *C21D 6/002* (2013.01); *C21D 6/005* (2013.01);
(Continued)

(58) Field of Classification Search
CPC ..... C22C 38/38; C22C 38/32; C22C 38/28; C22C 38/26; C22C 38/24; C22C 38/22;
(Continued)

(56) References Cited

U.S. PATENT DOCUMENTS 9,394,578 B2 * 7/2016 Lee ..... B21D 22/208
9,469,891 B2 * 10/2016 Okita ..... B21D 22/208
(Continued)

FOREIGN PATENT DOCUMENTS

JP 2006-200020 A 8/2006
JP 2007-016296 A 1/2007
(Continued)

OTHER PUBLICATIONS

Chinese Office Action dated Apr. 1, 2016 for Chinese Application No. 201380064153.6.
(Continued)

*Primary Examiner* — Veronica F Faison
(74) *Attorney, Agent, or Firm* — Hauptman Ham, LLP

(57) ABSTRACT

Disclosed are a hot stamping part with enhanced toughness and a method for manufacturing the same, in which the hot stamping part has a tensile strength (TS) of 700-1,200 MPa after hot stamping while guaranteeing elongation (EL) of 12% or more by adjusting alloy components and controlling process conditions.

9 Claims, 5 Drawing Sheets

(51) Int. Cl.

| | |
|---|---|
| ***C23C 2/06*** | (2006.01) |
| ***C22C 38/00*** | (2006.01) |
| ***C22C 38/02*** | (2006.01) |
| ***C22C 38/06*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |
| ***C23C 2/26*** | (2006.01) |
| ***C23C 2/28*** | (2006.01) |
| ***C21D 1/673*** | (2006.01) |
| ***C21D 6/00*** | (2006.01) |
| ***C21D 9/00*** | (2006.01) |
| ***C23C 2/02*** | (2006.01) |
| ***C23C 2/12*** | (2006.01) |

(52) U.S. Cl.

CPC ..... *C21D 6/008* (2013.01); *C21D 8/00* (2013.01); *C21D 8/005* (2013.01); *C21D 9/0068* (2013.01); *C22C 38/00* (2013.01); *C22C 38/02* (2013.01); *C22C 38/06* (2013.01); *C22C 38/22* (2013.01); *C22C 38/24* (2013.01); *C22C 38/26* (2013.01); *C22C 38/28* (2013.01); *C22C 38/32* (2013.01); *C23C 2/02* (2013.01); *C23C 2/06* (2013.01); *C23C 2/12* (2013.01); *C23C 2/26* (2013.01); *C23C 2/28* (2013.01); *C21D 2221/00* (2013.01)

(58) Field of Classification Search

CPC ..... C22C 38/06; C22C 38/02; C21D 8/005; C21D 9/0068; C21D 6/002; C21D 6/005; C21D 6/008; C23C 2/02; C23C 2/06; C23C 2/12; C23C 2/26

See application file for complete search history.

(56) References Cited

U.S. PATENT DOCUMENTS

| | | | | |
|---|---|---|---|---|
| 2002/0179206 | A1* | 12/2002 | Fujita | C21D 8/0226 148/602 |
| 2004/0238080 | A1* | 12/2004 | Vandeputte | C21D 8/0273 148/602 |
| 2010/0221573 | A1* | 9/2010 | Drillet | C21D 9/46 428/653 |
| 2011/0209800 | A1* | 9/2011 | Kim | C21D 6/00 148/533 |

FOREIGN PATENT DOCUMENTS

| | | | |
|---|---|---|---|
| JP | 2012-148305 | A | 8/2012 |
| KR | 1020050063917 | A | 6/2005 |
| KR | 100723159 | B1 | 11/2006 |
| KR | 100760152 | B1 | 9/2007 |
| KR | 1020090119264 | A | 11/2009 |
| KR | 1020100037854 | A | 4/2010 |
| KR | 1020100082537 | A | 7/2010 |
| KR | 1020110056888 | A | 5/2011 |
| KR | 101108838 | B1 | 1/2012 |
| KR | 10-2013-0002214 | A | 1/2013 |
| KR | 1020130027350 | A | 3/2013 |
| KR | 10-2013-0046967 | A | 5/2013 |
| WO | 2012/157581 | A1 | 11/2012 |

OTHER PUBLICATIONS

Extended European Search Report dated Apr. 18, 2016 for PCT/KR2013004293.

Japanese Office Action dated Jul. 15, 2016 for Japanese Application No. 2015-541671.

International Search Report for PCT/KR2013/004293 dated Feb. 4, 2014.

* cited by examiner (a) (b)

(a)

(b)

HOT STAMPING PRODUCT WITH ENHANCED TOUGHNESS AND METHOD FOR MANUFACTURING THE SAME

CROSS REFERENCE TO RELATED APPLICATION

This application claims the priority of Korean Patent Application No. 10-2013-0052405, filed on May 9, 2013 in the KIPO (Korean Intellectual Property Office). Further, this application is the National Phase application of International Application No. PCT/KR2013/004293 filed May 15, 2013, which designates the United States and was published in Korean.

TECHNICAL FIELD

The present invention relates to a hot stamped product and a method for manufacturing the same. More particularly, the present invention relates to a hot stamped product, which has improved toughness to guarantee a tensile strength (TS) of 700 to 1,200 MPa and an elongation (EL) of 12 wt % or more after hot stamping through adjustment of alloy components and control of process conditions, and a method for manufacturing the same.

BACKGROUND ART

With the development of automobiles having high fuel efficiency and light weight, automobile components have been continuously produced to have high strength. In addition, some parts of automobiles are required to have high strength and other parts are required to have high fracture toughness.

Particularly, steel sheets for automobiles are generally formed through pressing and thus require high ductility (elongation) to guarantee high press formability.

In the related art, high strength cold-rolled steel sheets having a tensile strength of 700 MPa to 1,200 MPa are not used in manufacture of complicated components for automobiles at room temperature due to a formation limit resulting from low ductility thereof, and when hot stamping is performed to overcome this problem, pressing is carried out at high temperature to provide improved formability, thereby enabling manufacture of complicated components. However, hot stamping causes significant variation in physical properties of the steel sheets. Particularly, after hot stamping, a conventional high strength cold-rolled steel sheet having a tensile strength (TS) of 700 MPa to 1,200 MPa has slightly increased strength, but has a significantly reduced elongation of 10 wt % or less, causing brittle fracture upon collision, thereby deteriorating impact stability.

In the related art, Korean Patent Publication No. 10-0723159 (Issue Date: 2007 May 30) discloses a cold-rolled steel sheet having excellent formability and a method for manufacturing the same.

DISCLOSURE

Technical Problem

It is one aspect of the present invention to provide a hot stamped product, which has improved toughness to guarantee an elongation (EL) of 12 wt % or more after hot stamping (hot pressing and mold cooling) through adjustment of alloy components and control of process conditions, thereby solving a problem of deterioration in impact resistance caused by brittle fracture due to low elongation.

It is another aspect of the present invention to provide a method for manufacturing a hot stamped product, which has improved toughness to guarantee an elongation (EL) of 12 wt % or more after hot stamping through adjustment of alloy components and control of process conditions, thereby securing impact performance characteristics.

It is a further aspect of the present invention to provide a method for manufacturing a hot stamped product that exhibits good impact absorption capability through laser welding and hot stamping of blanks having different strengths or thicknesses.

Technical Solution

In accordance with one aspect of the present invention, a hot stamped product includes: carbon (C): 0.05~0.14% by weight (wt %), silicon (Si): 0.01~0.55 wt %, manganese (Mn): 1.0~2.3 wt %, chromium (Cr): 0.01~0.38 wt %, molybdenum (Mo): 0.05~0.30 wt %, aluminum (Al): 0.01~0.10 wt %, titanium (Ti): 0.03~0.10 wt %, niobium (Nb): 0.02~0.10 wt %, vanadium (V): 0.05 wt % or less, boron (B): 0.001 wt % or less, and the balance of iron (Fe) and unavoidable impurities, and has a tensile strength (TS) of 700 MPa to 1,200 MPa and an elongation (EL) of 12.0% to 17.0% after hot stamping.

In accordance with another aspect of the present invention, a method for manufacturing a hot stamped product includes: (a) forming a cold-rolled steel sheet through pickling and cold rolling a hot-rolled steel sheet, the hot-rolled steel sheet including carbon (C): 0.05~0.14 wt %, silicon (Si): 0.01~0.55 wt %, manganese (Mn): 1.0~2.3 wt %, chromium (Cr): 0.01~0.38 wt %, molybdenum (Mo): 0.05~0.30 wt %, aluminum (Al): 0.01~0.10 wt %, titanium (Ti): 0.03~0.10 wt %, niobium (Nb): 0.02~0.10 wt %, vanadium (V): 0.05 wt % or less, boron (B): 0.001 wt % or less, and the balance of iron (Fe) and unavoidable impurities; (b) annealing the cold-rolled steel sheet at a temperature of 740° C. to 840° C., followed by hot dip plating; (c) cutting the hot dip-plated steel sheet to form a blank; (d) heating the blank to a temperature of 850° C. to 950° C.; and (e) transferring the heated blank to a press mold, followed by hot stamping and then cooling the pressed product within the press mold in a closed state, thereby forming a hot stamped product.

In accordance with a further aspect of the present invention, a method for manufacturing a hot stamped product includes: (a) forming a cold-rolled steel sheet through pickling and cold rolling a hot-rolled steel sheet, the hot-rolled steel sheet including carbon (C): 0.05~0.14 wt %, silicon (Si): 0.01~0.55 wt %, manganese (Mn): 1.0~2.3 wt %, chromium (Cr): 0.01~0.38 wt %, molybdenum (Mo): 0.05~0.30 wt %, aluminum (Al): 0.01~0.10 wt %, titanium (Ti): 0.03~0.10 wt %, niobium (Nb): 0.02~0.10 wt %, vanadium (V): 0.05 wt % or less, boron (B): 0.001 wt % or less, and the balance of iron (Fe) and unavoidable impurities; (b) annealing the cold-rolled steel sheet at a temperature of 740° C. to 840° C., followed by hot dip plating; (c) cutting the hot dip-plated steel sheet to form a first blank, followed by laser welding the first blank and a second blank having a different composition and thickness than those of the first blank; (d) heating the welded first and second blank to a temperature of 850° C. to 950° C.; and (e) transferring the heated first and second blanks to a press mold, followed by hot stamping and then cooling the pressed product within the press mold in a closed state, thereby forming a hot stamped product.

Advantageous Effects

The present invention can provide a complicated high strength automobile product having a tensile strength (TS) of 700 MPa to 1,200 MPa and an elongation (EL) of 12.0% to 17.0% through hot stamping so as to guarantee suitable strength and high fracture toughness. In addition, the present invention can guarantee excellent impact absorption capability when using blanks having different strengths as automobile components.

BEST MODE

Figure 1:
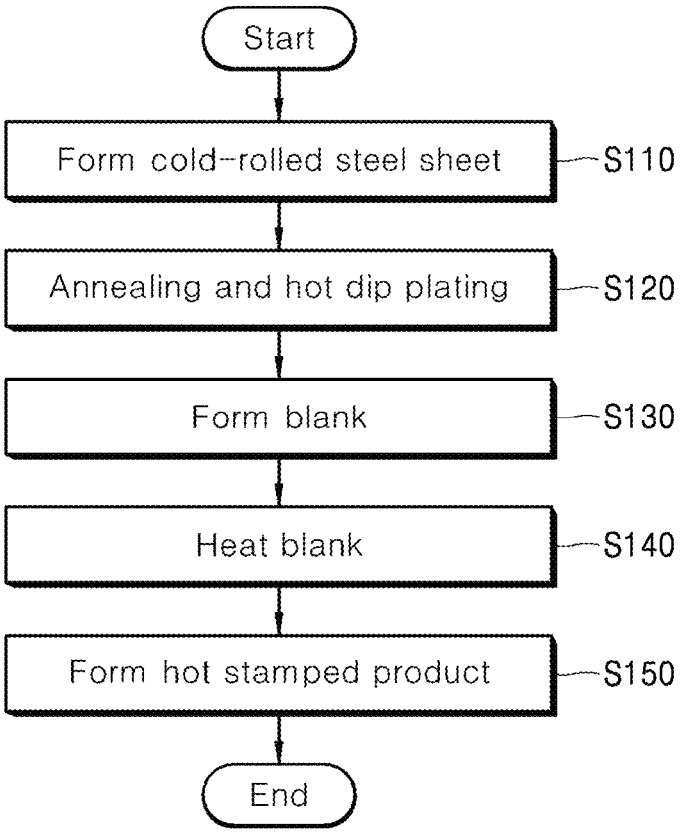
FIG. 1 is a flowchart of a method for manufacturing a hot stamped product according to one embodiment of the present invention.

The above and other aspects, features, and advantages of the present invention will become apparent from the detailed description of the following embodiments in conjunction with the accompanying drawings.

It should be understood that the present invention is not limited to the following embodiments and may be embodied in different ways, and that the embodiments are provided for complete disclosure and thorough understanding of the invention by those skilled in the art. The scope of the present invention will be defined only by the claims.

Hereinafter, a hot stamped product with improved toughness and a method for manufacturing the same according to embodiments of the present invention will be described in detail.

Hot Stamped Product

The present invention is aimed at providing a hot stamped product having a tensile strength (TS) of 700 MPa to 1,200 MPa and an elongation (EL) of 12.0% to 17.0% after hot stamping.

To this end, the hot stamped product according to the present invention includes: carbon (C): 0.05~0.14 wt %, silicon (Si): 0.01~0.55 wt %, manganese (Mn): 1.0~2.3 wt %, chromium (Cr): 0.01~0.38 wt %, molybdenum (Mo): 0.05~0.30 wt %, aluminum (Al): 0.01~0.10 wt %, titanium (Ti): 0.03~0.10 wt %, niobium (Nb): 0.02~0.10 wt %, vanadium (V): 0.05 wt % or less, boron (B): 0.001 wt % or less, and the balance of iron (Fe) and unavoidable impurities.

In addition, the hot stamped product may include at least one of phosphorus (P): 0.04 wt % or less and sulfur (S): 0.015 wt % or less.

Next, the amounts and functions of the respective components included in the hot stamped product, more specifically, a cold-rolled steel sheet for hot stamped products according to the present invention, will be described in more detail.

Carbon (C)

Carbon (C) is added to guarantee strength of steel. In addition, carbon serves to stabilize an austenite phase according to the amount of carbon in the austenite phase.

Preferably, carbon is present in an amount of 0.05~0.14 wt % based on the total weight of the steel. If the carbon content is less than 0.05 wt %, it is difficult to secure sufficient strength. On the contrary, if the carbon content exceeds 0.14 wt %, the steel can suffer from significant deterioration in toughness and weldability despite increase in strength.

Silicon (Si)

Silicon (Si) serves to improve strength and elongation of steel.

Preferably, silicon is present in an amount of 0.01~0.55 wt % based on the total weight of the steel. If the silicon content is less than 0.01 wt %, the effects provided by addition of silicon can be insufficient. On the contrary, if the silicon content exceeds 0.55 wt %, the steel can suffer from significant deterioration in weldability and wettability.

Manganese (Mn)

Manganese (Mn) serves to stabilize the austenite microstructure while enhancing strength of steel.

Preferably, manganese is present in an amount of 1.0~2.3 wt % based on the total weight of the steel. If the manganese content is less than 1.0 wt %, the effects provided by addition of manganese can be insufficient. On the contrary, if the manganese content exceeds 2.3 wt %, the steel can suffer from deterioration in weldability and toughness.

Chromium (Cr)

Chromium (Cr) improves elongation through stabilization of ferrite crystal grains, and increases strength through stabilization of austenite by increasing the amount of carbon in the austenite phase Preferably, chromium is present in an amount of 0.01~0.38 wt % based on the total weight of the steel. If the chromium content is less than 0.01 wt %, the effect provided by addition of chromium can become insufficient. On the contrary, if the chromium content exceeds 0.38 wt %, strength of the steel can excessively increase after hot stamping, thereby deteriorating impact absorption capability.

Molybdenum (Mo)

Molybdenum (Mo) serves to enhance strength of steel together with chromium.

Preferably, molybdenum is present in an amount of 0.05~0.30 wt % based on the total weight of the steel. If the molybdenum content is less than 0.05 wt %, the effects provided by addition of molybdenum can be insufficient. On the contrary, if the molybdenum content exceeds 0.30 wt %, the steel can suffer from deterioration in weldability.

Aluminum (Al)

Aluminum (Al) acts as a decarburization material while enhancing strength of steel by suppressing precipitation of cementite and stabilizing the austenite microstructure.

Preferably, aluminum (Al) is present in an amount of 0.01~0.10 wt % based on the total weight of the steel. If the aluminum content is less than 0.01 wt %, it is difficult to achieve austenite stabilization. On the contrary, if the aluminum content exceeds 0.10 wt %, there can be a problem of nozzle blocking in manufacture of steel, and hot embrittlement can occur due to Al oxide upon casting, thereby causing cracking and deterioration in ductility.

Titanium (Ti)

Titanium (Ti) serves to enhance elongation of steel by reducing the carbon content in the steel through precipitation of carbide in a hot stamping process.

Preferably, titanium is present in an amount of 0.03~0.10 wt % based on the total weight of the steel. If the titanium content is less than 0.03 wt %, the effects provided by addition of titanium can be insufficient. On the contrary, if the titanium content exceeds 0.10 wt %, the steel can suffer from deterioration in toughness.

Niobium (Nb)

Niobium (Nb) serves to promote grain refinement and enhance fracture toughness through formation of precipitates, and to enhance elongation through reduction in the content of carbon dissolved in steel through precipitation of carbide.

Preferably, niobium is present in an amount of 0.02~0.10 wt % based on the total weight of the steel. If the niobium content is less than 0.02 wt %, the effect provided by addition of niobium can become insufficient. On the contrary, if the niobium content exceeds 0.10 wt %, the steel can suffer from excessive increase in yield strength and deterioration in toughness.

Vanadium (V)

Vanadium (V) serves to enhance strength of steel through precipitation hardening by formation of precipitates together with niobium.

Preferably, vanadium is present in an amount of 0.05 wt % or less based on the total weight of the steel. If the vanadium content exceeds 0.05 wt %, the steel can suffer from deterioration in low temperature fracture toughness.

Boron (B)

Boron (B) enhances hardenability of steel by retarding phase transformation through precipitation at austenite grain boundaries.

Preferably, boron is present in an amount of 0.001 wt % or less based on the total weight of the steel. If the boron content exceeds 0.001 wt %, the steel can suffer from significant deterioration in toughness due to excessive increase in quenching properties.

Phosphorus (P), Sulfur (S)

An excess of phosphorus (P) causes significant deterioration in elongation. Accordingly, in the present invention, phosphorus is added in an amount of 0.04 wt % or less based on the total weight of the steel.

In addition, an excess of sulfur (S) causes embrittlement by forming an excess of MnS inclusions. Accordingly, in the present invention, sulfur is added in an amount of 0.015 wt % or less based on the total weight of the steel.

A cold-rolled steel sheet having the composition as set forth above and applied to a hot stamped product may guarantee a tensile strength (TS) of 700 MPa to 1,200 MPa after hot stamping and an elongation (EL) of 12.0% to 17.0%, and exhibits excellent impact absorption capability while securing suitable strength within this range. Particularly, when the hot stamped product has a tensile strength of less than 700 MPa after hot stamping, the steel sheet has low impact resistance, whereby invasion depth caused by collision can be increased, thereby reducing a safety space. On the contrary, when the hot stamped product has a tensile strength of greater than 1,200 MPa after hot stamping, such high strength can cause brittle fracture at a stress concentration spot upon collision. Particularly, when hot stamped product has an elongation of less than 12.0%, there can be a problem of fracture due to brittle fracture upon collision.

On the other hand, the hot stamped product according to the present invention may include a plating layer containing zinc, for example, an Al—Si layer, a hot-dip galvanizing layer, and a hot-dip galvannealing layer, on a surface of the steel sheet. When the steel sheet does not include such a plating layer, the surface of the steel sheet is oxidized upon heating the steel sheet for hot stamping, thereby causing generation of surface defects and deterioration in corrosion resistance. When hot stamped product is manufactured using such a plated steel sheet, the plating layer suppresses oxidation of the steel sheet during heating and remains after hot stamping, thereby providing corrosion resistance.

Method of Manufacturing Hot Stamped Product

FIG. 1 is a flowchart of a method for manufacturing a hot stamped product according to one embodiment of the present invention.

Referring to FIG. 1, the method for manufacturing a hot stamped product according to one embodiment includes forming a cold-rolled steel sheet (S110), annealing and hot dip plating (S120), forming a blank (S130), heating the blank (S140), and forming a hot stamped product (S150).

Formation of Cold-Rolled Steel Sheet

In the operation of forming a cold-rolled steel sheet (S110), a cold-rolled steel sheet is formed by pickling and cold rolling a hot-rolled steel sheet.

Here, the hot-rolled steel sheet may be manufactured by reheating, hot rolling, and cooling/winding a steel slab that comprises: carbon (C): 0.05~0.14 wt %, silicon (Si): 0.01~0.55 wt %, manganese (Mn): 1.0~2.3 wt %, chromium (Cr): 0.01~0.38 wt %, molybdenum (Mo): 0.05~0.30 wt %, aluminum (Al): 0.01~0.10 wt %, titanium (Ti): 0.03~0.10 wt %, niobium (Nb): 0.02~0.10 wt %, vanadium (V): 0.05 wt % or less, boron (B): 0.001 wt % or less, and the balance of iron (Fe) and unavoidable impurities.

The hot-rolled steel sheet may further include at least one of phosphorus (P): 0.04 wt % or less and sulfur (S): 0.015 wt % or less.

Annealing and Hot Dip Plating

In the operation of annealing and hot dip plating (S120), the cold-rolled steel sheet is subjected to annealing at 740° C. to 840° C., followed by hot dip plating.

In this operation, if the annealing temperature is less than 740° C., insufficient recrystallization of a ferrite microstructure occurs, thereby causing deterioration in ductility after hot stamping. On the contrary, if the annealing temperature exceeds 840° C., grain growth occurs in the course of annealing, thereby reducing strength of the steel sheet after hot stamping.

Here, hot dip plating may be performed by one process selected from among Al—Si plating, hot-dip galvanizing, and hot-dip galvannealing.

Formation of Blank

In the operation of forming a blank (S130), a blank is formed by cutting the hot dip-plated steel sheet. The blank is designed corresponding to a mold shape.

Blank Heating

In the operation of heating the blank (S140), the blank is heated at 850° C. to 950° C. for 3~10 minutes.

In this operation, if the heat treatment temperature of the blank is less than 850° C. or if the heat treatment time of the blank is less than 3 minutes, it is difficult to secure desired strength after hot stamping and there is a problem of deterioration in hot pressing formability. On the contrary, if the heat treatment temperature of the blank exceeds 950° C. or if the heat treatment time of the blank exceeds 10 minutes, there is a problem of deterioration in strength after hot stamping due to excessive growth in austenite grains.

Formation of Hot Stamped Product

In the operation of forming a hot stamped product (S150), the heated blank is transferred to a press mold, followed by hot stamping and then cooling in the press mold in a closed state, thereby forming a hot stamped product.

The interior of the press mold is maintained at high temperature immediately after pressing. Thus, when the blank is cooled by opening the press mold immediately after pressing, the blank can suffer from deterioration in material characteristics and shape deformation. Accordingly, the blank is preferably cooled within the press mold in a closed state, while pressing the press mold with a press.

Particularly, the heated blank is preferably transferred to the press mold within 15 seconds in order to minimize decrease in temperature of the heated blank resulting from exposure to air at room temperature during transfer of the heated blank. Although not shown in the drawings, the press mold may be provided with a cooling channel in which a refrigerant circulates. The heated blank can be rapidly cooled through circulation of the refrigerant supplied through the cooling channel.

In order to maintain a desired shape of the blank while preventing a spring back phenomenon of the blank, it is desirable that quenching of the blank be performed while pressing the press mold in a closed state.

Particularly, cooling of the blank within the closed press mold may be performed by quenching the blank to a temperature of 200° C. at a cooling rate of 30° C./sec to 300° C./sec for 5 seconds to 18 seconds. A cooling rate exceeding 300° C./sec can be advantageous in terms of securing strength of the steel, but provides difficulty in securing elongation. On the contrary, if cooling is performed at a rate of less than 30° C./sec or for a period of time of less than 5 seconds, it is difficult to guarantee high strength.

The hot stamped product manufactured by operations S110~S150 as described above can exhibit a tensile strength (TS) of 700 MPa to 1,200 MPa and an elongation (EL) of 12.0% to 17.0% after hot stamping.

That is, in the present invention, after the blank is subjected to heat treatment at a temperature of 850° C. to 950° C., which corresponds to an austenite transformation temperature zone, for 3 to 10 minutes, the heated blank is subjected to hot stamping within the press mold, thereby enabling manufacture of a product having a complicated shape while suppressing brittle fracture and improving impact performance through improvement in toughness by securing an elongation of 12% or more after hot stamping. By way of example, the hot stamped product according to the present invention may be an automobile center-pillar.

Figure 2:
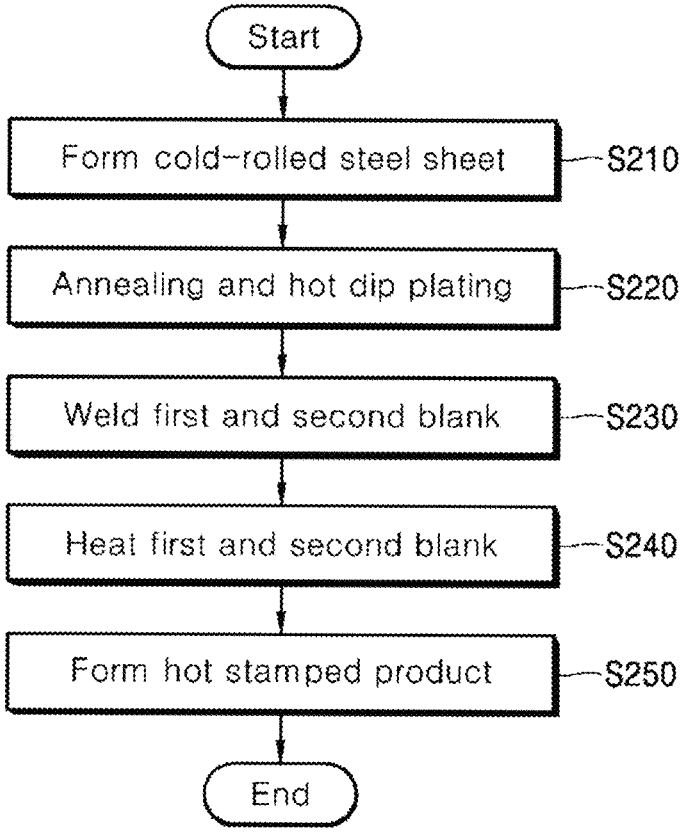
FIG. 2 is a flowchart of a method for manufacturing a hot stamped product according to another embodiment of the present invention.

FIG. 2 is a flowchart of a method for manufacturing a hot stamped product according to another embodiment of the present invention.

Referring to FIG. 2, the method for manufacturing a hot stamped product according to another embodiment includes forming a cold-rolled steel sheet (S210), annealing and hot dip plating (S220), welding first and second blanks (S230), heating first and second blanks (S240), and forming a hot stamped product (S250). In this embodiment, the operation of forming a cold-rolled steel sheet (S210) and the operation of annealing and hot dip plating (S220) are substantially the same as the operation of forming a cold-rolled steel sheet (S110 of FIG. 1) and the operation of annealing and hot dip plating (S120 of FIG. 1). Thus, a description of the method for manufacturing a hot stamped product according to this embodiment will start from the operation of welding first and second blanks (S230).

Welding First and Second Blanks

In the operation of welding first and second blanks (S230), a first blank is formed by cutting the hot dip-plated steel sheet, and the first blank is welded to a second blank having a different composition than the first blank.

The second blank may include (C): 0.12~0.42 wt %, silicon (Si): 0.03~0.60 wt %, manganese (Mn): 0.8~4.0%, phosphorus (P): 0.2 wt % or less, sulfur (S): 0.1 wt % or less, chromium (Cr): 0.01~1.0%, boron (B): 0.0005~0.03 wt %, at least one of aluminum (Al) and titanium (Ti): 0.05~0.3 wt % (in a total sum), at least one of nickel (Ni) and vanadium (V): 0.03~4.0 wt % (in a total sum), and the balance of iron (Fe) and unavoidable impurities.

The first blank and the second blank may have the same thickness. Alternatively, the first blank and the second blank may have different thicknesses depending upon desired strength or properties.

Heating First and Second Blanks

In the operation of heating the first and second blanks (S240), the first and second blanks welded to each other are heated at 850° C. to 950° C. for 3 minutes to 10 minutes. In this embodiment, heat treatment of the blanks is performed substantially in the same manner as in the above embodiment of FIG. 1, and thus a repeated description thereof is omitted.

Formation of Hot Stamped Product

In the operation of forming a hot stamped product (S250), the heated first and second blanks are transferred to a press mold to perform hot stamping, and are then cooled in the press mold in a closed state, thereby forming a hot stamped product. Here, hot stamping is performed substantially in the same manner as in the above embodiment of FIG. 1, and thus a repeated description thereof is omitted.

The hot stamped product manufactured by the operations S210~S250 as described above has heterogeneous strength and may include a first part that exhibits a tensile strength (TS) of 700 MPa to 1,200 MPa and an elongation (EL) of 12.0% to 17.0%, and a second part that exhibits a tensile strength (TS) of 1,200 MPa to 1,600 MPa and an elongation (EL) of 6.0% to 10.0%.

Figure 3:
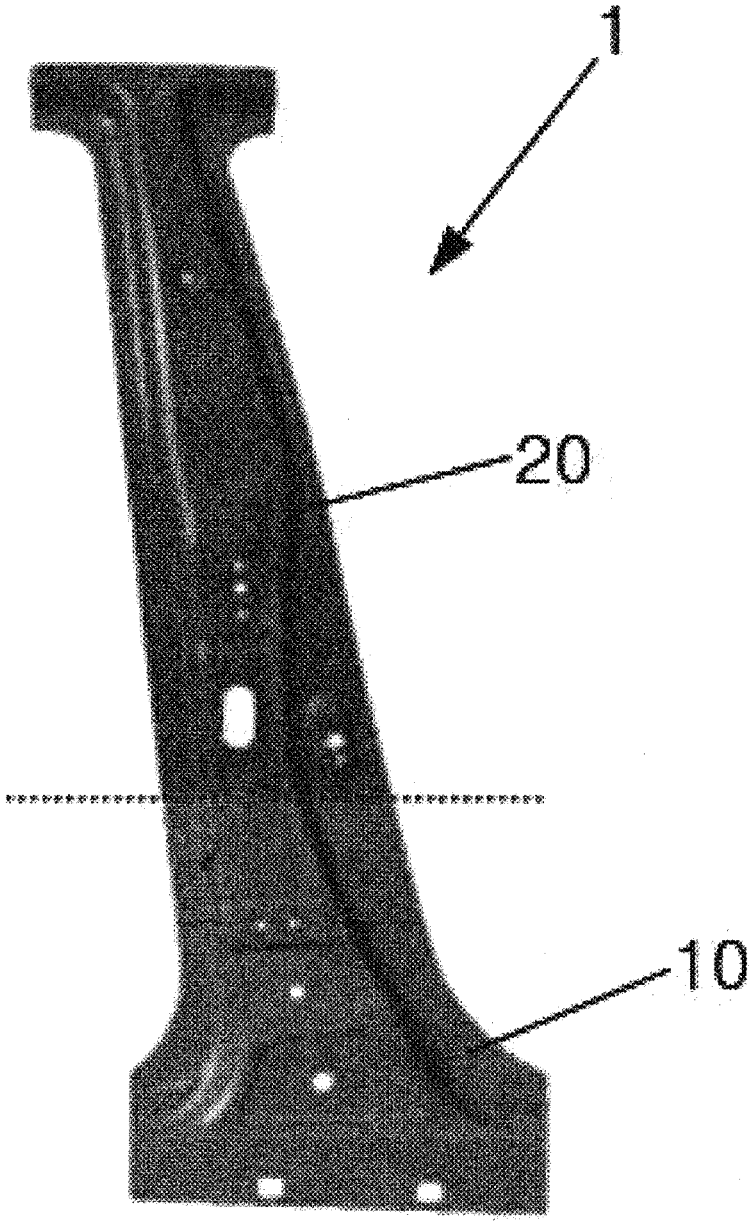
FIG. 3 is a view of a hot stamped product having heterogeneous strength.

FIG. 3 is a view of a hot stamped product having heterogeneous strength.

As shown in FIG. 3, a hot stamped product 1 having heterogeneous strength may include a first part 10 that exhibits a tensile strength (TS) of 700 MPa to 1,200 MPa and an elongation (EL) of 12.0% to 17.0%, and a second part 20 that exhibits a tensile strength (TS) of 1,200 MPa to 1,600 MPa and an elongation (EL) of 6.0% to 10.0%. Here, the first part 10 of the hot stamped product 1 serves to absorb impact upon collision and the second part 20 serves to endure impact upon collision.

In this way, the hot stamped product manufactured by butt welding blanks of heterogeneous materials is applied to an automobile component having locally different strength, thereby achieving weight reduction and improvement in fuel efficiency of automobiles.

EXAMPLES

Next, the present invention will be described in more detail with reference to examples. Here, the following examples are provided for illustration only and should not be construed in any way as limiting the present invention.

Descriptions of details apparent to those skilled in the art will be omitted.

1. Preparation of Specimen

In Examples 1 to 4 and Comparative Examples 1 to 24, each of specimens was prepared according to compositions as listed in Tables 1 and 2. In Examples 1 to 4 and Comparative Examples 1 to 24, a hot rolled specimen was subjected to pickling, followed by cold rolling and annealing under conditions shown in Table 4. Then, after Al—Si plating, the specimen was cut to form a blank, which in turn was subjected to heat treatment at 930° C. for 4 minutes under conditions shown in Table 4 and transferred to a press mold within 10 seconds, followed by hot stamping. Thereafter, with the press mold closed, the resulting product was subjected to quenching to 70° C. at a cooling rate of 100° C./sec for 15 seconds.

It should be noted that alloy components listed in Tables 1 and 2 are provided in unit of wt %.

TABLE 1

(Unit: wt %)

| Item | C | Si | Mn | P | S | Cr | Mo | Al | Nb | Ti | V | B |
|---|---|---|---|---|---|---|---|---|---|---|---|---|
| Example 1 | 0.066 | 0.03 | 1.76 | 0.013 | — | 0.03 | 0.21 | 0.03 | 0.050 | 0.065 | 0.001 | 0.0001 |
| Example 2 | 0.063 | 0.27 | 1.81 | 0.013 | 0.001 | 0.03 | 0.21 | 0.02 | 0.048 | 0.065 | 0.001 | 0.0001 |
| Example 3 | 0.070 | 0.03 | 1.83 | 0.012 | — | 0.21 | 0.22 | 0.04 | 0.050 | 0.069 | 0.002 | 0.0001 |
| Example 4 | 0.102 | 0.03 | 1.78 | 0.012 | — | 0.03 | 0.23 | 0.04 | 0.047 | 0.048 | 0.001 | 0.0001 |
| Comparative Example 1 | 0.075 | 0.03 | 1.52 | 0.018 | — | 0.02 | — | 0.04 | 0.046 | 0.068 | 0.006 | 0.0002 |
| Comparative Example 2 | 0.068 | 0.27 | 1.79 | 0.013 | — | 0.03 | 0.01 | 0.03 | 0.052 | 0.070 | 0.001 | 0.0002 |
| Comparative Example 3 | 0.070 | 0.03 | 1.48 | 0.013 | — | 0.23 | — | 0.04 | 0.050 | 0.050 | 0.001 | 0.0003 |
| Comparative Example 4 | 0.067 | 0.03 | 1.77 | 0.012 | — | 0.03 | 0.04 | 0.04 | 0.049 | 0.067 | 0.001 | 0.0001 |
| Comparative Example 5 | 0.101 | 0.03 | 1.79 | 0.012 | — | 0.03 | — | 0.04 | 0.047 | 0.047 | 0.001 | 0.0001 |
| Comparative Example 6 | 0.068 | 0.03 | 1.58 | 0.013 | — | 0.12 | — | 0.02 | 0.050 | 0.060 | 0.001 | 0.0002 |
| Comparative Example 7 | 0.048 | 0.03 | 1.78 | 0.011 | — | 0.02 | 0.18 | 0.03 | 0.046 | 0.063 | 0.002 | 0.0001 |
| Comparative Example 8 | 0.172 | 0.03 | 1.75 | 0.013 | — | 0.03 | 0.22 | 0.04 | 0.050 | 0.062 | 0.001 | 0.0001 |
| Comparative Example 9 | 0.062 | — | 1.71 | 0.011 | — | 0.04 | 0.20 | 0.03 | 0.052 | 0.045 | 0.002 | 0.0003 |
| Comparative Example 10 | 0.068 | 0.57 | 1.77 | 0.012 | — | 0.04 | 0.23 | 0.03 | 0.049 | 0.055 | 0.001 | 0.0003 |

TABLE 2

| Item | C | Si | Mn | P | S | Cr | Mo | Al | Nb | Ti | V | B |
|---|---|---|---|---|---|---|---|---|---|---|---|---|
| Comparative Example 11 | 0.061 | 0.04 | 0.95 | 0.013 | — | 0.04 | 0.23 | 0.05 | 0.044 | 0.052 | 0.002 | 0.0002 |
| Comparative Example 12 | 0.063 | 0.05 | 2.32 | 0.013 | — | 0.03 | 0.22 | 0.04 | 0.063 | 0.062 | 0.001 | 0.0001 |
| Comparative Example 13 | 0.064 | 0.05 | 1.81 | 0.050 | — | 0.03 | 0.21 | 0.04 | 0.059 | 0.061 | 0.002 | 0.0001 |
| Comparative Example 14 | 0.066 | 0.04 | 1.88 | 0.012 | 0.018 | 0.05 | 0.20 | 0.04 | 0.058 | 0.063 | 0.003 | 0.0002 |
| Comparative Example 15 | 0.058 | 0.05 | 1.72 | 0.012 | — | 0.008 | 0.08 | 0.05 | 0.051 | 0.065 | 0.003 | 0.0002 |
| Comparative Example 16 | 0.069 | 0.03 | 1.75 | 0.016 | — | 0.39 | 0.24 | 0.03 | 0.052 | 0.068 | 0.002 | 0.0001 |
| Comparative Example 17 | 0.062 | 0.03 | 2.15 | 0.023 | — | 0.03 | 0.21 | 0.007 | 0.048 | 0.063 | 0.001 | 0.0002 |
| Comparative Example 18 | 0.086 | 0.04 | 1.85 | 0.010 | — | 0.05 | 0.22 | 0.12 | 0.049 | 0.062 | 0.002 | 0.0002 |
| Comparative Example 19 | 0.064 | 0.05 | 1.73 | 0.010 | — | 0.03 | 0.20 | 0.04 | 0.052 | 0.027 | 0.002 | 0.0001 |
| Comparative Example 20 | 0.068 | 0.05 | 1.82 | 0.010 | — | 0.02 | 0.19 | 0.04 | 0.050 | 0.125 | 0.001 | 0.0001 |
| Comparative Example 21 | 0.067 | 0.05 | 1.81 | 0.011 | — | 0.04 | 0.23 | 0.05 | 0.018 | 0.061 | 0.001 | 0.0003 |
| Comparative Example 22 | 0.069 | 0.07 | 1.84 | 0.010 | — | 0.03 | 0.23 | 0.03 | 0.115 | 0.057 | 0.003 | 0.0004 |
| Comparative Example 23 | 0.072 | 0.02 | 1.75 | 0.012 | — | 0.06 | 0.20 | 0.05 | 0.054 | 0.053 | 0.062 | 0.0002 |
| Comparative Example 24 | 0.073 | 0.12 | 1.79 | 0.013 | — | 0.07 | 0.21 | 0.03 | 0.054 | 0.069 | 0.001 | 0.0030 |

2. Mechanical Properties

Table 3 shows mechanical properties of the specimens of Examples 1 to 4 and Comparative Examples 1 to 24, and Table 4 shows mechanical properties of the specimens of Examples 1 to 4 and Comparative Examples 1 to 6 before and after hot stamping according to annealing temperature.

TABLE 3

| Item | Properties after hot stamping TS (MPa) | EL (%) |
|---|---|---|
| Example 1 | 797 | 16.5 |
| Example 2 | 822 | 14.3 |
| Example 3 | 949 | 13.6 |
| Example 4 | 1,166 | 12.1 |
| Comparative Example 1 | 614 | 19.4 |
| Comparative Example 2 | 790 | 10.8 |
| Comparative Example 3 | 670 | 9.4 |
| Comparative Example 4 | 688 | 12.6 |
| Comparative Example 5 | 1,005 | 2.9 |
| Comparative Example 6 | 674 | 9.4 |
| Comparative Example 7 | 598 | 21.2 |
| Comparative Example 8 | 1,305 | 5.9 |
| Comparative Example 9 | 597 | 6.5 |

TABLE 3-continued

| Item | Properties after hot stamping TS (MPa) | EL (%) |
|---|---|---|
| Comparative Example 10 | 897 | 8.2 |
| Comparative Example 11 | 589 | 19.1 |
| Comparative Example 12 | 1,021 | 5.3 |
| Comparative Example 13 | 733 | 11.3 |
| Comparative Example 14 | 743 | 6.9 |
| Comparative Example 15 | 697 | 14.5 |
| Comparative Example 16 | 802 | 10.5 |
| Comparative Example 17 | 754 | 11.6 |
| Comparative Example 18 | 827 | 10.3 |
| Comparative Example 19 | 691 | 12.7 |
| Comparative Example 20 | 783 | 9.5 |
| Comparative Example 21 | 592 | 6.5 |
| Comparative Example 22 | 893 | 11.2 |
| Comparative Example 23 | 822 | 10.3 |
| Comparative Example 24 | 897 | 9.1 |

TABLE 4

| Item | Annealing temperature (° C.) | Mechanical properties after annealing and hot dip plating (Al—Si) TS (MPa) | EL (%) | Mechanical properties after hot stamping (930° C.) TS (MPa) | EL (%) | Strength (MPa) 700~1,200 | Elongation (%) 12 ↑ |
|---|---|---|---|---|---|---|---|
| Example 1 | 680 | 1,206 | 0.4 | 841 | 10.5 | ○ | x |
| | 740 | 1,073 | 9.5 | 797 | 16.5 | ○ | ○ |
| | 840 | 748 | 18.3 | 782 | 17.4 | ○ | ○ |
| Example 2 | 680 | 1,204 | 0.6 | 842 | 4.2 | ○ | x |
| | 740 | 1,062 | 9.5 | 822 | 14.3 | ○ | ○ |
| | 840 | 790 | 16.2 | 829 | 14.2 | ○ | ○ |
| Example 3 | 680 | 1,277 | 0.5 | 1,031 | 7.3 | ○ | x |
| | 740 | 1,165 | 7.9 | 949 | 13.6 | ○ | ○ |
| | 840 | 784 | 18.4 | 913 | 14.2 | ○ | ○ |
| Example 4 | 680 | 621 | 0.7 | 1,186 | 5.5 | ○ | x |
| | 740 | 1,148 | 8.5 | 1,166 | 12.1 | ○ | ○ |
| | 840 | 815 | 19.2 | 1,018 | 12.4 | ○ | ○ |
| Comparative | 680 | 562 | 25.7 | 622 | 20.2 | x | ○ |
| Example 1 | 740 | 543 | 27.0 | 614 | 19.4 | x | ○ |
| | 840 | 537 | 28.1 | 606 | 18.3 | x | ○ |
| Comparative | 680 | 1,100 | 0.7 | 823 | 10.9 | ○ | x |
| Example 2 | 740 | 1,001 | 8.4 | 790 | 10.8 | ○ | x |
| | 840 | 741 | 20.0 | 800 | 9.4 | ○ | x |
| Comparative | 680 | 893 | 2.6 | 693 | 13.7 | x | ○ |
| Example 3 | 740 | 865 | 8.6 | 670 | 9.4 | x | x |
| | 840 | 643 | 21.4 | 602 | 10.3 | x | x |
| Comparative | 680 | 1,109 | 0.8 | 774 | 11.1 | ○ | x |
| Example 4 | 740 | 996 | 11.2 | 688 | 12.6 | x | ○ |
| | 840 | 684 | 21.7 | 750 | 4.1 | ○ | x |
| Comparative | 680 | 531 | 1.3 | 836 | 9.6 | ○ | x |
| Example 5 | 740 | 925 | 12.7 | 1,005 | 2.9 | ○ | x |
| | 840 | 693 | 25.2 | 1,096 | 5.0 | ○ | x |
| Comparative | 680 | 982 | 0.7 | 632 | 14.2 | x | ○ |
| Example 6 | 740 | 911 | 11.0 | 674 | 9.4 | x | x |
| | 840 | 648 | 24.4 | 636 | 12.3 | x | ○ |

From Tables 1 to 4, it can be seen that the specimens prepared in Examples 1 to 4 and having the composition according to the invention had desired mechanical properties, that is, a tensile strength (TS) of 700 MPa to 1,200 MPa and an elongation (EL) of 12.0% to 17.0%. As can be seen from Table 4, which shows annealing temperature and mechanical properties after hot dip plating, when the specimen having the alloy composition according to the present invention was subjected to annealing at a temperature of 680° C. out of the range of the invention, the specimen failed to obtain desired tensile strength (TS) and elongation (EL).

Conversely, the specimens of Comparative Examples 1 to 24 failed to obtain desired tensile strength (TS) and elongation (EL) at the same time. That is, it could be seen that, for the specimens of Comparative Examples 1 to 24, the specimen having desired tensile strength (TS) failed to obtain desired elongation (EL), and the specimen having desired elongation (EL) failed to obtain desired tensile strength (TS).

Figure 4:
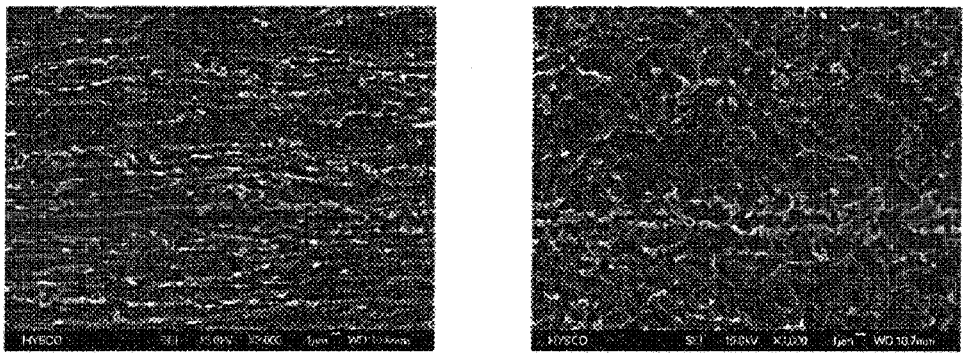
FIG. 4 shows micrographs of a specimen prepared in Example 1 before hot stamping.
Figure 5:
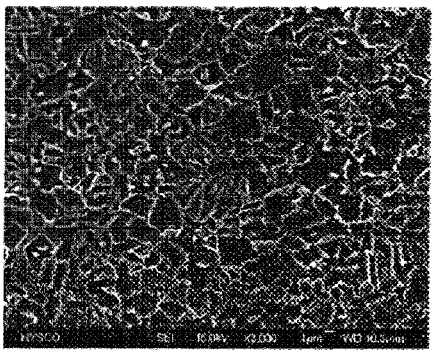
FIG. 5 shows micrographs of the specimen prepared in Example 1 after hot stamping.
Figure 5:
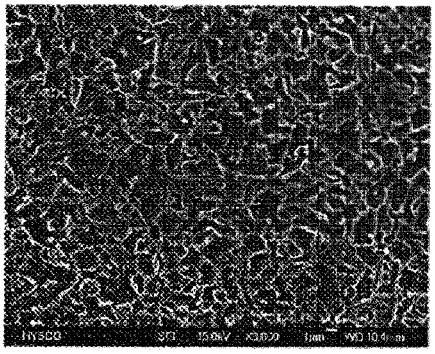

On the other hand, FIG. 4 shows micrographs of a specimen prepared in Example 1 before hot stamping, and FIG. 5 shows micrographs of the specimen prepared in Example 1 after hot stamping. In FIGS. 4 and 5, (a) shows a micrograph of the specimen obtained by annealing at 740° C. and (b) shows a micrograph of the specimen obtained by annealing at 840° C.

As shown in FIG. 4(*a*), it could be seen that, when annealing was performed at 740° C., ferrite recrystallization started and small amounts of microstructure deformed by cold rolling remained, instead of complete ferrite recrystallization. In addition, as shown in FIG. 4(*b*), it could be seen that, when annealing was performed at 840° C., ferrite recrystallization was completely carried out and grain growth occurred. In other words, substantially no ferrite recrystallization occurs at an annealing temperature of 740° C. or less, whereby an uneven microstructure can be formed and affect microstructure of the steel after hot stamping, thereby causing decrease in elongation. Conversely, overgrowth of grains occurs at an annealing temperature of greater than 840° C., thereby causing deterioration in strength after hot stamping.

Further, in FIGS. 5 (*a*) and (*b*), it could be seen that, after hot stamping, the specimen of Example 1 had a complex microstructure composed of ferrite and martensite having fine grains and precipitates uniformly and densely formed. With such microstructure, the steel has high toughness while maintaining a tensile strength of 700 or more.

Although some embodiments have been disclosed herein, it should be understood that these embodiments are provided for illustration only and various modifications, changes, and alterations can be made without departing from the scope of the present invention. Therefore, the scope and sprit of the invention should be defined only by the accompanying claims and equivalents thereof.

The invention claimed is:

1. A method for manufacturing a hot stamped product, comprising:

(a) forming a cold-rolled steel sheet through pickling and cold rolling a hot-rolled steel sheet, the hot-rolled steel sheet comprising carbon (C): 0.05~0.14 wt %, silicon (Si): 0.01~0.55 wt %, manganese (Mn): 1.0~2.3 wt %, chromium (Cr): 0.01~0.38 wt %, molybdenum (Mo): 0.05~0.30 wt %, aluminum (Al): 0.01~0.10 wt %, titanium (Ti): 0.03~0.10 wt %, niobium (Nb): 0.02~0.10 wt %, vanadium (V): 0.05 wt % or less, boron (B): 0.001 wt % or less, and the balance of iron (Fe) and unavoidable impurities;

(b) annealing the cold-rolled steel sheet at a temperature of 740° C. to 840° C., followed by hot dip plating;

(c) cutting the hot dip-plated steel sheet to form a blank;

(d) heating the blank to a temperature of 850° C. to 950° C.; and (e) transferring the heated blank to a press mold, followed by hot stamping and then cooling the pressed product within the press mold in a closed state, thereby forming a hot stamped product, wherein the hot stamped product has a tensile strength (TS) of 700 MPa to 1,200 MPa and an elongation (EL) of 12.0% to 17.0% after hot stamping.

2. The method according to claim 1, wherein the hot-rolled steel sheet comprises at least one of phosphorus (P): 0.04 wt % or less and sulfur (S): 0.015 wt % or less.

3. The method according to claim 1, wherein in (b) annealing the cold-rolled steel sheet, hot dip plating is performed by one selected from among Al—Si plating, hot-dip galvanizing, and hot-dip galvannealing.

4. The method according to claim 1, wherein in (d) heating the blank, heat treatment of the blank is performed for 3 to 10 minutes.

5. The method according to claim 1, wherein in (e) transferring the heated blank, the heated blank is transferred to the press mold within 15 seconds.

6. The method according to claim 1, wherein cooling the pressed product within the press mold in a closed state comprises cooling the pressed product at a cooling rate of 30° C./sec to 300° C./sec for 5 seconds to 18 seconds, followed by quenching to 200° C. or less.

7. A method for manufacturing a hot stamped product, comprising:

(a) forming a cold-rolled steel sheet through pickling and cold rolling a hot-rolled steel sheet, the hot-rolled steel sheet including carbon (C): 0.05~0.14 wt %, silicon (Si): 0.01~0.55 wt %, manganese (Mn): 1.0~2.3 wt %, chromium (Cr): 0.01~0.38 wt %, molybdenum (Mo): 0.05~0.30 wt %, aluminum (Al): 0.01~0.10 wt %, titanium (Ti): 0.03~0.10 wt %, niobium (Nb): 0.02~0.10 wt %, vanadium (V): 0.05 wt % or less, boron (B): 0.001 wt % or less, and the balance of iron (Fe) and unavoidable impurities;

(b) annealing the cold-rolled steel sheet at a temperature of 740° C. to 840° C., followed by hot dip plating;

(c) cutting the hot dip-plated steel sheet to form a first blank, followed by laser welding the first blank and a second blank having a different composition and thickness than those of the first blank;

(d) heating the welded first and second blank to a temperature of 850° C. to 950° C.; and (e) transferring the heated first and second blanks to a press mold, followed by hot stamping and then cooling the pressed product within the press mold in a closed state, thereby forming a hot stamped product, wherein the hot stamped product has a tensile strength (TS) of 700 MPa to 1,200 MPa and an elongation (EL) of 12.0% to 17.0% after hot stamping.

8. The method according to claim 7, wherein the second blank comprises carbon (C): 0.12~0.42 wt %, silicon (Si): 0.03~0.60 wt %, manganese (Mn): 0.8~4.0 wt %, phosphorus (P): 0.2 wt % or less, sulfur (S): 0.1 wt % or less, chromium (Cr): 0.01~1.0 wt %, boron (B): 0.0005~0.03 wt %, at least one of aluminum (Al) and titanium (Ti): 0.05~0.3 wt (in a total sum), at least one of nickel (Ni) and vanadium (V): 0.03~4.0 wt % (in a total sum), and the balance of iron (Fe) and unavoidable impurities.

9. The method according to claim 7, wherein after step (e), the first blank has a tensile strength (TS) of 700 MPa to 1,200 MPa and an elongation (EL) of 12.0% to 17.0%, and the second blank has a tensile strength (TS) of 1,200 MPa to 1,600 MPa and an elongation (EL) of 6.0% to 10.0%.

* * * * *